US005228389A

United States Patent [19]

Simeth

[11] Patent Number: 5,228,389

[45] Date of Patent: Jul. 20, 1993

[54] OSCILLATING FORM ROLLER IN THE INKING MECHANISM OF A PRINTING PRESS

[75] Inventor: Claus Simeth, Offenbach, Fed. Rep. of Germany

[73] Assignee: MAN Miller Druckmaschinen GmbH, Geisenheim, Fed. Rep. of Germany

[21] Appl. No.: 688,604

[22] PCT Filed: Oct. 10, 1990

[86] PCT No.: PCT/EP90/01695

§ 371 Date: Jun. 4, 1991

§ 102(e) Date: Jun. 4, 1991

[87] PCT Pub. No.: WO91/05662

PCT Pub. Date: Mar. 2, 1991

[30] Foreign Application Priority Data

Oct. 12, 1989 [DE] Fed. Rep. of Germany ..... 3934070

[51] Int. Cl.[5] ..... B41F 13/00

[52] U.S. Cl. ..... 101/348; 101/DIG. 38

[58] Field of Search ..... 101/348, 349, 350, DIG. 38

[56] References Cited

U.S. PATENT DOCUMENTS

| | | | |
|---|---|---|---|
| 4,513,663 | 4/1985 | Hummel et al. | 101/349 |
| 4,546,701 | 10/1985 | Junghams | 101/349 |
| 4,739,703 | 4/1988 | Eguchi | 101/349 |
| 4,829,645 | 5/1989 | Kannwischer | 101/348 |
| 4,887,533 | 12/1989 | Lemaster et al. | 101/348 |
| 4,953,462 | 9/1990 | Krober | 101/348 |
| 5,062,362 | 11/1991 | Kemp | 101/348 |
| 5,065,676 | 11/1991 | Hardin | 101/348 |
| 5,107,761 | 4/1992 | Greive | 101/350 |

FOREIGN PATENT DOCUMENTS

| | | |
|---|---|---|
| 0047861 | 3/1982 | European Pat. Off. . |
| 143240 | 5/1985 | European Pat. Off. . |
| 139802 | 3/1903 | Fed. Rep. of Germany . |
| 3540837 | 7/1986 | Fed. Rep. of Germany . |
| 3629825 | 3/1987 | Fed. Rep. of Germany . |
| 3638826 | 5/1988 | Fed. Rep. of Germany . |
| 3800658 | 7/1989 | Fed. Rep. of Germany . |

*Primary Examiner*—Edgar S. Burr
*Assistant Examiner*—Lynn D. Hendrickson
*Attorney, Agent, or Firm*—Spencer, Frank & Schneider

[57] ABSTRACT

An oscillating form roller in the inking mechanism of a printing press includes a roller casing which is rotatable and axially displaceable relative to a roller shaft. During its axial displacement the roller casing encounters set collars that are fastened to the roller shaft so as to be continuously adjustable. Friction surfaces are provided so that, in this contacting position, the set collars and the roller shaft are caused to rotate in synchronism with the roller casing.

6 Claims, 1 Drawing Sheet

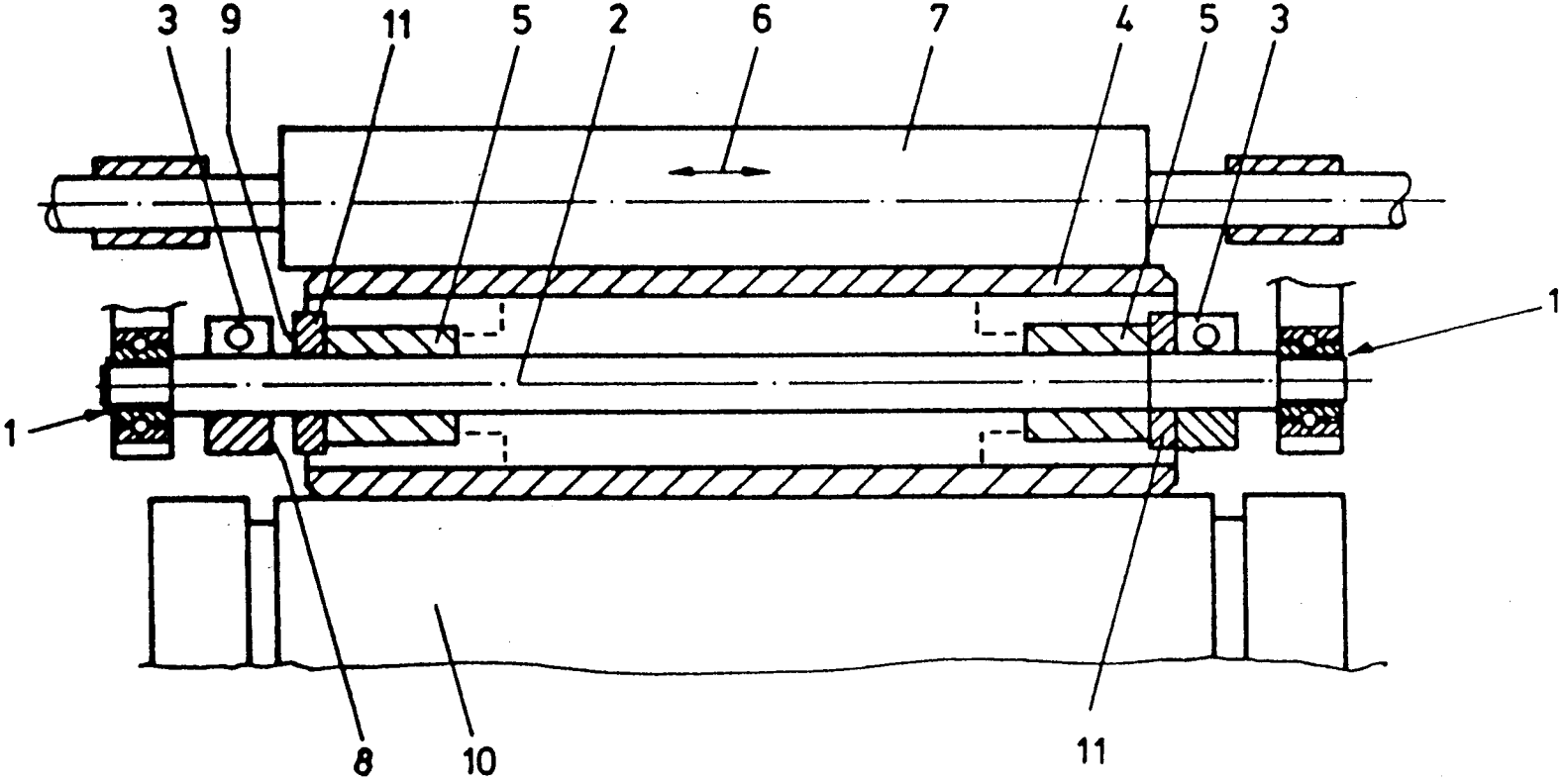
1
3
5
4
7
6
2
5
11
9
3
1
11
10
8

OSCILLATING FORM ROLLER IN THE INKING MECHANISM OF A PRINTING PRESS

BACKGROUND OF THE INVENTION

The invention relates to an oscillating form roller in the inking mechanism of a printing press, the form roller including a roller shaft that is rotatably supported in bearings on both sides and a roller casing which is held at the shaft by way of bearings so as to be rotatable and axially displaceable relative to the shaft, with stops to limit the axial movement of the roller casing being fastened to the shaft in a manner secured against rotation. By way of a distributor roller in contact with the roller casing, the latter can be driven into rotation and axially displaced.

Oscillating form rollers operating according to this principle have been known for a long time. As an example of a more recent development, reference is made to European Patent No. 143,240. This reference discloses a specific configuration of such an oscillating form roller, with the axial displacement of the roller casing being effected against springs. The stops are here disposed within the roller casing. This construction is relatively expensive, particularly because of the two springs and their stops. An even greater drawback is that high quality bearings must be employed there between the roller shaft and the roller casing because these bearings must permit not only the axial displacement of the casing relative to the shaft, but must also absorb differences in the rates of rotation between the roller shaft and the roller casing ranging from zero to the maximum number of revolutions of the roller casing. Thus, two bearing systems are provided in the interior of the form roller, namely a pin bearing system and a ball bearing system. However, both bearing systems are only difficultly accessible for maintenance, which is a further drawback of this prior art system.

SUMMARY OF THE INVENTION

The invention avoids these drawbacks. It has as its object to propose an oscillating form roller having the above mentioned features which is distinguished, in particular, by a noticeable structural improvement. In particular, it should be possible to employ bearings between the shaft and the casing which can be produced economically and need meet only low requirements with respect to maintenance, even over long periods of operation.

To solve this problem, the invention is characterized in that the stops in the form of set collars are fastened to the roller shaft outside of the roller casing and have friction surfaces at their interior faces oriented toward the form roller. These friction faces cooperate with counter-friction faces at the end faces of the roller casing in such a manner that, if one of the counter-friction faces of the roller casing lies against the oppositely disposed friction face of the associated set collar, the roller shaft is driven into rotation by the driven roller casing.

By these simple measures, a synchronous or practically synchronous drive is realized between the roller casing and the roller shaft, so that the bearing between these two components, in operation, practically need only take care of the axial displaceability of the casing relative to the shaft; practically no or only very slight differences in the rates of rotation occur between these two components during operation.

The oppositely disposed faces of the set collars and of the roller casing need not be provided with special friction coatings, although this is certainly possible if a particularly high friction force is to be transmitted. Generally it will suffice if these components (set collars, on the one hand, and roller casing, on the other hand) contact one another with their conventionally worked, metal surfaces because even then sufficient friction force is transmitted between these two components to carry the shaft along in synchronism or practically in synchronism with the casing.

It is preferred to have the set collars continuously variable and clampable on the roller shaft, since this then sets the axial stroke of the form roller correspondingly, namely in dependence on the axial stroke of the distributor roller lying against it.

The deformation of the finest picture element dots, as it occurs during the printing process if several distributing form rollers are employed in an inking mechanism, no longer occurs in the arrangement according to the invention. For example, four distributing (oscillating) form rollers may be employed without adversely affecting the quality of the printed product.

BRIEF DESCRIPTION OF THE DRAWING

The sole FIGURE is a schematic longitudinal sectional view of the essential components of a form roller according to the invention with a distributor roller contacting it and a plate cylinder contacting it.

BRIEF DESCRIPTION OF THE PREFERRED EMBODIMENT

A roller shaft 2 is rotatably mounted in bearings 1 that are fixed to the press. On both sides, set collars 3 are seated on the roller shaft and can be fastened to it in a continuously adjustable manner.

A roller casing 4 is pushed onto shaft 2. Casing 4 is able to rotate relative to the shaft in bearings 5 and can be axially displaced in the direction of double arrow 6.

A distributor roller 7 lies against the outer circumference of casing 4 and is driven in the direction of arrow 6 so as to rotate within the inking mechanism of the respective printing press while being axially displaced (oscillating). This rotary movement and the axial displacement are transmitted by distributor roller 7 to the casing 4 of the form roller, with the form roller being axially displaced between the two set collars 3 that serve as stops.

Friction faces 8 and counter-friction faces 9 are formed between the interior faces of set collars 3 and the oppositely disposed end faces of casing 4.

The drawing FIGURE shows on the right how the friction faces and counter-friction faces lie against one another to thus carry along shaft 2. In this way, the number of revolutions of the shaft is always synchronized again with the number of revolutions of the casing and the shaft rotates along in the bearings. An axial bearing as required in a prior art system is thus unnecessary.

The drawing FIGURE also shows a plate cylinder 10 with whose circumference the oscillating form roller is in contact.

Preferably, rings 11, for example of rubber or plastic, are seated on shaft 2 at the end face of the form roller. They serve as wear components during contact of the form roller on the respective set collar 3, as damping members and to increase friction. The rings rotate along with the roller casing and are exchangeably fastened to it.

I claim:

1. An oscillating form roller arrangement for use in an inking mechanism of a printing press, the inking mechanism including a distributor roller which is rotated and oscillated, the oscillating form roller arrangement comprising:

a roller shaft;

bearing means for rotatably mounting the roller shaft adjacent the distributor roller;

a roller casing through which the roller shaft extends, the roller casing having first and second ends and having a periphery;

further bearing means for mounting the roller casing on the roller shaft so that the roller casing is rotatable and axially displaceable with respect to the roller shaft and so that the periphery of the roller casing contacts the distributor roller, the roller casing being rotated and axially displaced by the distributor roller;

first and second set collars fastened to the roller shaft to limit the axial displacement of the roller casing, the first set collar having an inner side which faces the first end of the roller casing and the second set collar having an inner side which faces the second end of the roller casing; and friction means, at the inner sides of the set collars and the ends of the roller casing, for frictionally coupling the roller casing to a set collar when axial displacement of the roller casing is limited by that set collar so as to rotate the roller shaft along with the roller casing.

2. The form roller arrangement of claim 1, wherein the friction means comprises a first friction ring disposed at the first end of the roller casing and a second friction ring disposed at the second end of the roller casing.

3. The form roller arrangement of claim 2, wherein the friction rings comprise polymeric material.

4. The form roller arrangement of claim 3, wherein the polymeric material is rubber.

5. The form roller arrangement of claim 3, wherein the polymeric material is plastic.

6. The form roller arrangement of claim 1, wherein the set collars are continuously adjustable on and clampable to the roller shaft.

* * * * *